United States Patent [19]

Duncan et al.

[11] Patent Number: 4,585,543

[45] Date of Patent: Apr. 29, 1986

[54] METHOD FOR RECOVERING HYDROCARBONS FROM SOLIDS

[75] Inventors: Dennis A. Duncan, Sharon; Herman Woebeke, Barnstable, both of Mass.

[73] Assignee: Stone & Webster Engineering Corp., Boston, Mass.

[21] Appl. No.: 587,905

[22] Filed: Mar. 9, 1984

[51] Int. Cl.[4] ..... C10B 49/10; C10B 53/06; C10G 1/00

[52] U.S. Cl. ..... 208/11 R; 208/8 R; 208/127; 34/26; 201/29

[58] Field of Search ..... 208/8 R, 11 R, 37, 177, 208/127; 34/22, 26; 201/31, 29

[56] References Cited

U.S. PATENT DOCUMENTS

| | | | |
|---|---|---|---|
| 3,501,394 | 3/1970 | Lyons | 208/11 R |
| 4,293,401 | 10/1981 | Sieg et al. | 208/11 R |
| 4,312,740 | 1/1982 | Chiaramonte | 208/11 R |
| 4,318,798 | 3/1982 | Albrecht et al. | 208/11 R |
| 4,340,463 | 7/1982 | Harak | 208/11 R |
| 4,388,173 | 6/1983 | Escher et al. | 208/11 R |
| 4,402,823 | 9/1983 | Bertelsen | 208/11 R |

*Primary Examiner*—John Doll
*Assistant Examiner*—Glenn A. Caldarola
*Attorney, Agent, or Firm*—Hedman, Gibson, Costigan & Hoare

[57] ABSTRACT

A system is provided for recovering hydrocarbons from hydrocarbon-containing solids such as oil shale, tar sands or coal. The process includes preheating finely divided solids prior to introduction to a low residence time tubular reactor where a portion of the hydrocarbon is removed from the solids. The solids are then separated from the hydrocarbon product, stripped of residual hydrocarbons then transferred to a gasifier to burn the remaining entrapped hydrocarbon to serve as the heat source for the process.

10 Claims, 10 Drawing Figures

METHOD FOR RECOVERING HYDROCARBONS FROM SOLIDS

The present invention relates to an improvement in the recovery of hydrocarbons from solids such as oil shale, coal, or tar sands. More particularly, the invention provides a method for separating oil from a solid by the use of thermal regenerative cracking technology (TRC). The invention provides a means wherein, for example, finely divided shale, coal or tar sands may be subjected to a preheating stage and a secondary heat treating stage that utilizes a tubular reactor to separate a portion of the hydrocarbon content. Thereafter, the remaining solids are transferred to a gasifier to serve as the fuel source for the process.

U.S. Pat. No. 4,318,800; U.S. Pat. No. 4,288,235; and U.S. Pat. No. 4,338,187 disclose a TRC apparatus. These patents are incorporated by reference.

The process of the invention may utilize means for delivery of finely divided oil containing solids to a low residence time reactor where it is intimately mixed with a gaseous inert carrier. The resulting product is discharged as a stream comprised of the gaseous separated oil, and residual oil containing solids. The gaseous separated oil is thereafter recovered in a separator and the solids are sent to a gasifier by means of an air-lift.

DESCRIPTION OF THE PREFERRED EMBODIMENT

The present invention is directed to removal of hydrocarbons from solids that contain hydrocarbons. These materials include oil shale and tar sands and coal.

Figure 1:
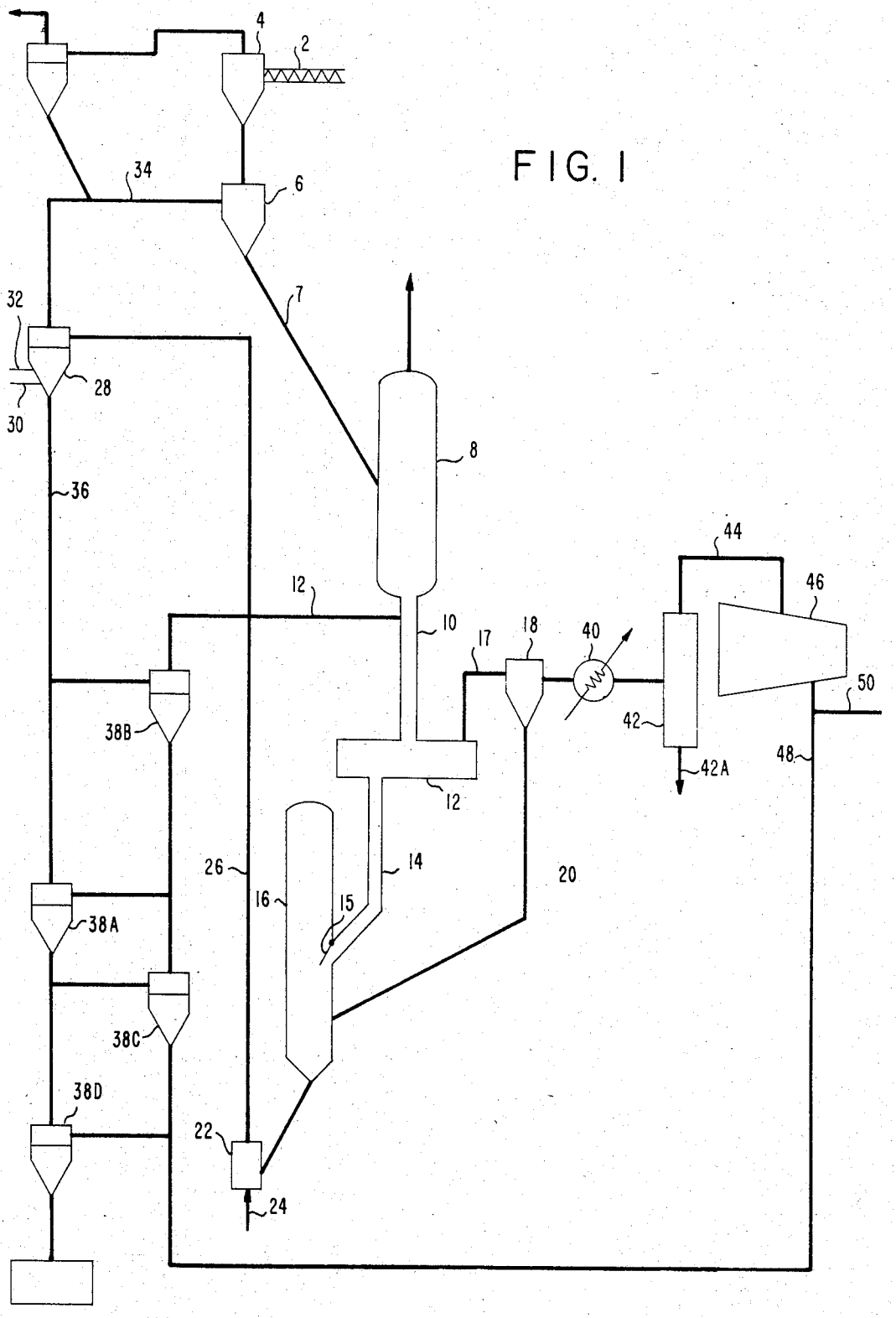
FIG. 1 is a schematic diagram of the hydrocarbon processing system using recycled gas for reaction heat.

As best seen in FIG. 1, the apparatus particularly suited for the process of the invention includes a solid feed intake 2 which feeds finely divided oil shale through a screw feeder to a flash drier 4 to remove any residual moisture. The finely divided shale should have a particle size ranging from 0.5 to 500 microns. The oil shale is then transferred to preheater 6 where it is heated to a temperature of 600° to 800° F. The preheated oil shale fines are then fed into upper reservoir 8 through line 7 where said oil shale is fed into reactor 10 where it is contacted with recycle gas at 1400° F. that is fed through line 12. The recycle gas and the shale fines flow downward together through reactor 10 and exit at a temperature of 1200° F. and are passed directly to separator 12 where the treated shale fines containing about 50% of the original oil content are recovered from the gaseous separated oil.

The residence time in the reactor will be from 0.005 to 2 seconds. The rapid heating of the finely divided shale will obviate some coking because of the explosive outgassing of the hydrocarbons from the shale rock. Thus the polymerization of hydrocarbon (kerogen) and loss of useful products that occurs will be prevented. The treated shale fines are discharged from separator 12 through line 14 which is connected to a fluidized bed stripping vessel 16 which is fluidized with steam or another inert fluidizing gas fed through line 21. Cyclone 18 is used to return solid fines to stripper 16. The treated shale fines are passed from stripper 16 to holding tank 22 where they are transferred to line 26 by a gaseous fluid 24 such as compressed air and air-lifted to coke gasifier 28 which is provided with steam inlet line 30 and air inlet 32 to gasify the treated shale fines to provide the energy source for the process. The coke gasifier 28 is operated at a temperature of from 1500°–1800° F. and the hot gas is passed through line 34 to the preheater 6 where it preheats the oil shale fines. The spent shale is discharged through line 36 into a cyclone cascade which consists of cyclones 38A, 38B, 38C and 38D. These cyclones are used to collect waste heat from both the spent shale and the gasifier overhead stream using countercurrent direct heat exchange.

The separator 12 is connected to cyclone 18 by line 17. The gaseous oil fraction is then passed to heat exchanger 40 where it is cooled before being passed to heavy oil separator 42 which separates heavy oil at line 42A from a gaseous fraction that is passed overhead to a compressor 46 through line 44. The recycle gas is passed through line 48 to cyclone 38C. Line 44 connects the compressor 46 with heat exchanger 40 that is connected to an oil recovery system (not illustrated) and to recycle oil line 48.

Figure 2:
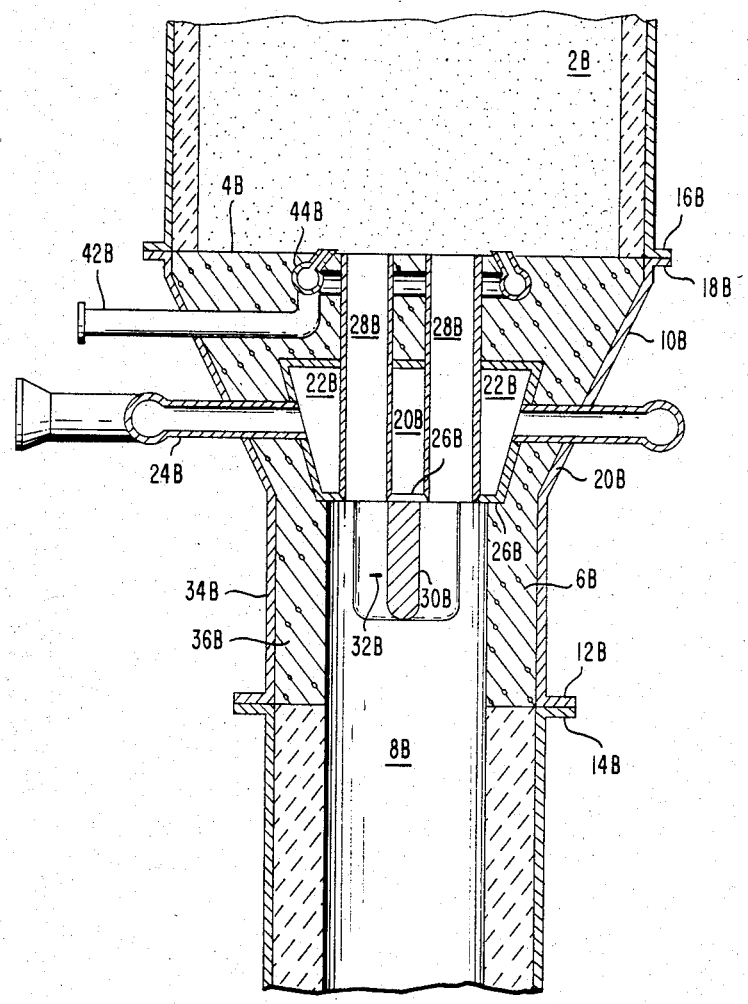
FIG. 2 is a cross-sectional elevational view of the hydrocarbon containing solids feeding device that feeds the hydrocarbon containing solids to the tubular reactor.

An embodiment of the hydrocarbon containing solids feeding device is best seen in FIG. 2. The finely divided oil shale is fed downwardly from the base 4B of the upper reservoir 8 into the top of the ceramic lining 6B of the reactor 10. Housing 10B encloses and supports the elements that are described below. Housing 10B has a frustroconical shape and serves as a transitional spool piece between the reservoir 8 and the reactor 10 which is flangeably connected via flanges 12B, 14B, 16B and 18B. The configuration of the housing is not critical and it may be varied depending upon the particular solid that is to be processed as a feedstock. The main housing 20B is comprised of an outer metallic shell, preferably of steel and an inner ceramic lining 6B of a castable ceramic material. A gas distribution chamber 22B is supplied with hot gaseous feed at a temperature of about 1400° F. through inlet 24B. The chamber 22B may be of unitary construction or it may be a removable plate 26B. One or a plurality of conduits 28B extend downwardly from the reservoir 8 to the reactor 10 passing through the base 4B and the chamber 22B. Conduits 28B are in communication with both the reservoir 8 and the reactor 10 to permit solids to flow through the hot gaseous stream fed through inlet 24B.

The conduits 28B extend through the ceramic liner of housing 10B and terminate coplanarly with the base plate 26B. The plug 30B extends downwardly from plate 26B and interrupts the flow path from conduits 28B to form a discrete mixing zone 32B. The housing 20B may contain a neck portion 34B with corresponding ceramic line 36B. Ceramic liner 38B is provided on the interior of wall 40B of the reservoir to impart erosion resistance. Steam intake line 42B is connected to manifold 44B to provide a means for agitating the finely divided shale and prevent blockages.

Figure 3:
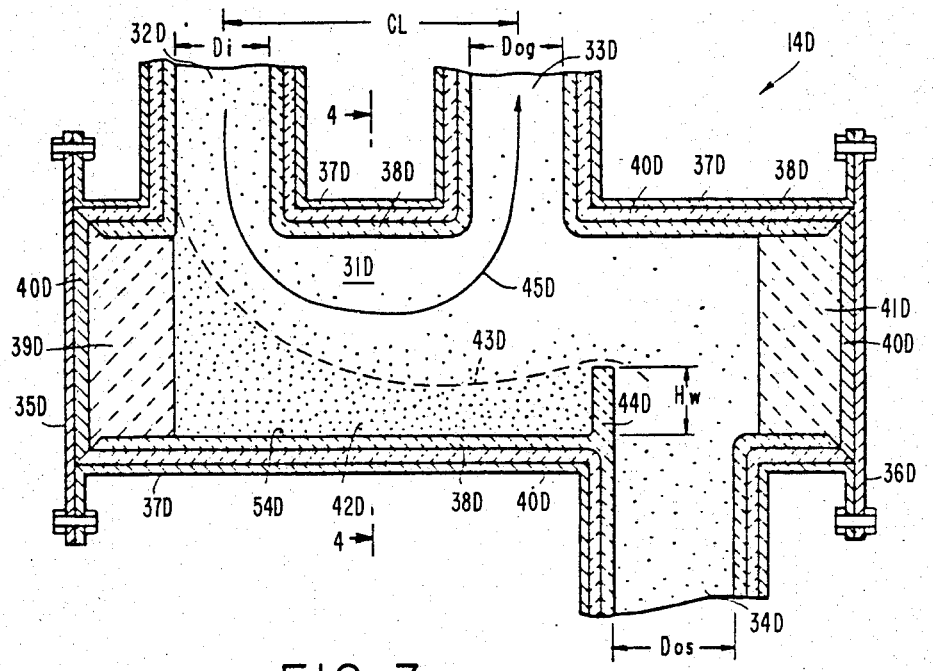
FIG. 3 is a cross-sectional elevation of the preferred embodiment of a separator.

The separator 12 is best seen in FIG. 3 which is a cross sectional elevation view of a solids-gas separator device useful in the apparatus of FIG. 1. The separator 12 is provided with a separator shell 37D and is comprised of a solids-gas disengaging chamber 31D having an inlet 32D for the mixed phase stream, a gas phase outlet 33D and a solids phase outlet 34D. The inlet 32D and the solids outlet 34D are preferably located at opposite ends of the chamber 31D with the gas outlet 33D at a point therebetween. Clean out and maintenance manways 35D and 36D may be provided at either end of the chamber 31D. The separator shell 37D and manways 35D and 36D preferably are lined with erosion resistant linings 38D, 39D and 41D respectively which may be required due to the action of solids at high velocities. Typical commerically available materials for erosion resistant linings are Carborundum Precast Carbofax D, Carborundum Precast Alfrax 201 or their equivalent. A thermal insulation lining 40D may be placed between shell 37D and lining 38D and between the manways and their respective erosion resistant lining. Thus process temperatures of 1100° F. to 1800° F. may be utilized.

Figure 4:
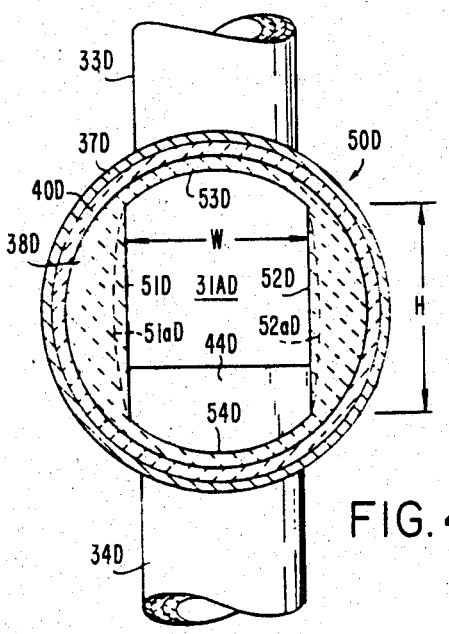
FIG. 4 is a cutaway view through section 4—4 of FIG. 3.
Figure 5:
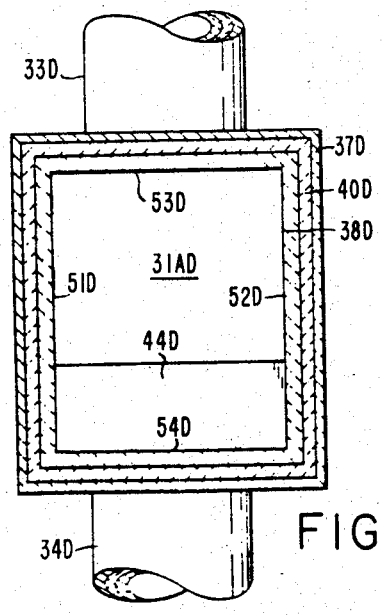
FIG. 5 is a cutaway view along section 4—4 of FIG. 3 wherein the separation shell is fabricated from a rectangular conduit.

FIG. 4 shows a cutaway view of the separator along section 4—4 of FIG. 3. For greater strength and ease of construction the shell of the separator 12 is preferably fabricated from cylindrical sections such as pipe 50D, although other materials may, of course, be used. It is essential that longitudinal side walls 51D and 52D should be rectilinear, or slightly arcuate as indicated by the dotted lines 51*a*D and 52*a*D. Thus, flow path 31D through the separator is essentially rectangular in cross section having a height H and width W as shown in FIG. 4. The embodiment shown in FIG. 4 defines the geometry of the flow path by adjustment of the lining width for walls 51D and 52D. Alternatively, baffles, inserts, weirs or other means may be used. In like fashion the configuration of walls 53D and 54D transverse to the flow path may be similarly shaped, although this is not essential. FIG. 5 is a cutaway view along Section 4—4 of FIG. 3 wherein the separation shell 37D is fabricated from a rectangular conduit. Because the shell 37D has rectilinear walls 51D and 52D it is not necessary to adjust the width of the flow path with a thickness of lining. Linings 38D and 40D could be added for erosion and thermal resistance respectively.

Again referring to FIG. 3, inlet 32D and outlets 33D are disposed normal to flow path 31D so that the incoming mixed phase stream from inlet 32D is required to undergo a 90° change in direction upon entering the chamber. As a further requirement, however, the gas phase outlet 33D is also oriented so that the gas phase upon leaving the separator has completed a 180° change in direction.

Centrifugal force propels the solid particles to the wall 54D opposite inlet 32D of the chamber 31D, while the gas portion, having less momentum, flows through the vapor space of the chamber 31D. Initially, solids impinge on the wall 54D, but subsequently accumulate to form a static bed of solids 42D, which ultimately form in a surface configuration having a curvilinear arc 43D of approximately 90°. Solids impinging upon the bed are moved along the curvilinear arc 43D to the solids outlet 34D which is preferably oriented for downflow of solids by gravity. The exact shape of the arc 43D is determined by the geometry of the particular separator and the inlet stream parameters such as velocity, mass flowrate, bulk density, and particle size. Because the force imparted to the incoming solids is directed against the static bed 42D rather than the separator 12 itself, erosion is minimal. Separator efficiency, defined as the removal of solids from the gas phase leaving through outlet 33D , is, therefore, not affected adversely by high inlet velocities, up to 150 ft./sec., and the separator 12 is operable over a wide range of dilute phase densities, preferably between 0.1 and 10.0 lbs./ft$^3$ . The separator 12 of the present invention achieves efficiencies of about 80%, although the preferred embodiment, discussed below, can obtain over 90% removal of solids.

It has been found that separator efficiency is dependent upon separator geometry inasmuch as the flow path must be essentially rectangular and the relationship between height H, and the sharpness of the U-bend in the gas flow is significant.

Referring to FIGS. 3 and 4 we have found that for a given height H of chamber 31D, efficiency increases as the 180° U-bend between inlet 32D and outlet 33D becomes progressively sharper; that is, as outlet 33D is brought progressively closer to inlet 32D. Thus, for a given H the efficiency of the separator increases as the flow path and, hence, residence time decreases. Assuming an inside diameter D, of inlet 32D, the preferred distance CL between the centerlines of inlet 32D and outlet 33 is less than 4.0 Di, while the most preferred distance between said centerlines is between 1.5 and 2.5 $D_i$. Below 1.5 $D_i$ better separation is obtained but difficulty in fabrication makes this embodiment less attractive in most instances. Should this latter embodiment be desired, the separator 14D would probably require a unitary casting design because inlet 32D and outlet 33D would be too close to one another to allow welded fabrication.

It has been found that the height of flow path H should be at least equal to the value of $D_i$ or 4 inches in height, whichever is greater. Practice teaches that if H is less than $D_i$ or 4 inches the incoming stream is apt to disturb the bed solids 42D, thereby re-entraining solids in the gas product leaving through outlet 33D. Preferably H is on the order of twice $D_i$ to obtain even greater separation efficiency. Although not otherwise limited it is apparent that too large an H eventually merely increases residence time without substantive increases in efficiency. The width W of the flow path is preferably between 0.75 and 1.25 times $D_i$, most preferably between 0.9 and 1.10 $D_i$.

Outlet 33D may be of any inside diameter. However, velocities greater than 75 ft./sec. can cause erosion because of residual solids entrained in the gas. The inside diameter of outlet 34D should be sized so that a pressure differential between the stripping vessel 16 shown in FIG. 1 and the separator 12 exist such that a static height of solids is formed in solids outlet line 14. The static height of solids in line 14 forms a positive seal which prevents gases from entering the stripping vessel 16. The magnitude of the pressure differential between the stripping vessel 16 and the separator 12 is determined by the force required to move the solids in bulk flow to the solids outlet 34D as well as the height of the solids in line 14. As the differential increases the net flow of gas to the stripping vessel 16 decreases. Solids, having gravitational momentum, overcome the differential, while gas preferentially leaves through the gas outlet 33D.

By regulating the pressure in the stripping vessel 16 it is possible to control the amount of gas going to the stripper. The pressure regulating means may include a check or "flapper" valve 15 at the outlet of line 14, or a pressure control device 19 on vessel 16. Alternatively, as suggested above, the pressure may be regulated by selecting the size of the outlet 34D and conduit 14 to obtain hydraulic forces acting on the system that set the flow of gas to the stripper 16. While such gas is degraded, we have found that an increase in separation efficiency occurs with a bleed of gas to the stripper of less than 10%, preferably between 2 and 7%. Economic and process considerations would dictate whether this mode of operation should be used. It is also possible to design the system to obtain a net backflow of gas from the stripping vessel. This gas flow should be less than 10% of the total feed gas rate.

By establishing a minimal flow path, consistent with the above recommendations, residence times as low as 0.1 seconds or less may be obtained, even in separators having inlets over 3 feet in diameter. Scale-up to 6 feet in diameter is possible in many systems where residence times approaching 0.5 seconds are allowable.

In the preferred embodiment of FIG. 3 a weir 44D is placed across the flow path at a point at or just beyond the gas outlet to establish a positive height of solids prior to solids outlet 34D. By installing a weir (or an equivalent restriction) at this point a more stable bed is established thereby reducing turbulence and erosion. Moreover, the weir 44D establishes a bed which has a crescent shaped curvilinear arc 43D of slightly more than 90°. An arc of this shape diverts gas toward the gas outlet and creates the U-shaped gas flow pattern illustrated diagrammatically by line 45D in FIG. 3. Without the weir 44D an arc somewhat less than or equal to 90° would be formed, and which would extend asymptotically toward outlet 34D as shown by dotted line 60D in the schematic diagram of the separator of FIG. 9. Although neither efficiency nor gas loss (to the stripping vessel) is affected adversely, the flow pattern of line 61D increases residence time, and more importantly, creates greater potential for erosion at areas 62D, 63D and 64D.

Figure 6:
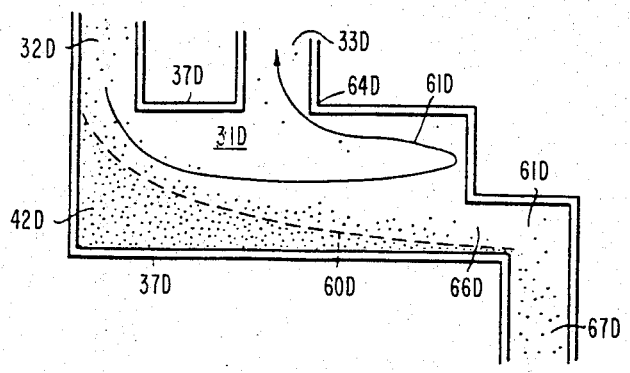
FIG. 6 is a sketch of a separation device indicating gas and solids phase flow patterns in a separator without a weir.
Figure 9:
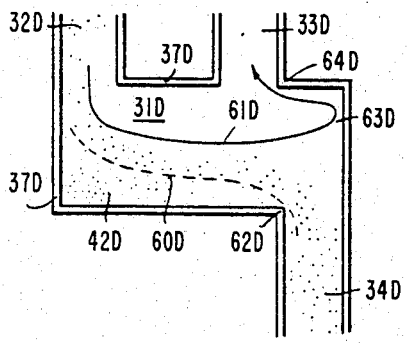
FIG. 9 is a sketch of the separation device of the present invention indicating gas and solids phase flow patterns in a separator without a weir.

The separator of FIG. 6 is a schematic diagram of another embodiment of the separator 12, said separator 12 having an extended separation chamber in the longitudinal dimension. Here, the horizontal distance L between the gas outlet 33D and the solids outlet 67D is extended to establish a solids bed of greater length. L is preferably less than or equal to 5 $D_1$. Although the gas flow pattern 61D does not develop the preferred U-shape, a crescent shaped arc is obtained which limits erosion potential to area 64D. The embodiments shown by FIG. 9 is useful when the solids loading of the incoming stream is low. The embodiment of FIG. 9 also has a minimum pressure loss and may be used when the velocity of the incoming stream is low.

Figure 7:
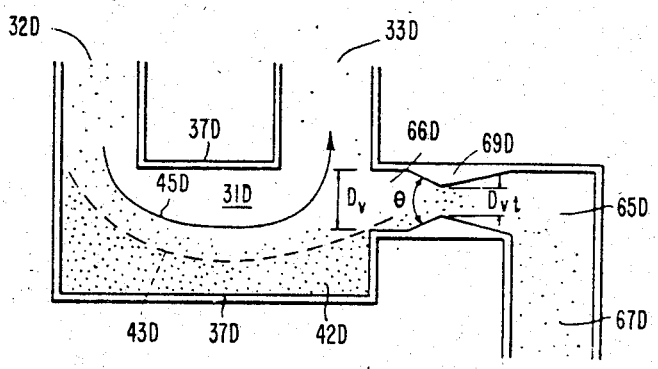
FIG. 7 is a sketch of an alternate embodiment of the separation device wherein a venturi restriction is incorporated in the colinear section of the solids outlet.
Figure 8:
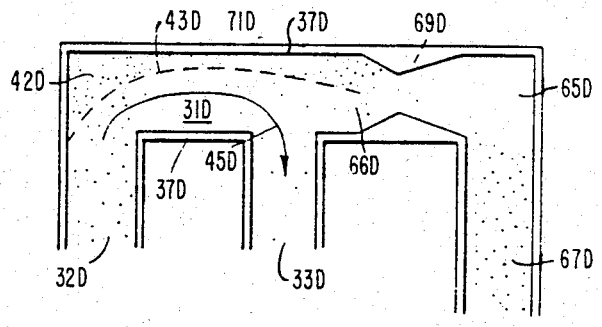
FIG. 8 is a sketch of an alternate embodiment of the separation device.

As shown in the embodiment in FIG. 7 it is equally possible to use a stepped solids outlet 65D having a section 66D collinear with the flow path as well as a gravity flow section 67D. A venturi 69D is placed in the colinear section 66D to greatly improve the deaeration of the solids. Wall 68D replaces their weir 44D, and arc 43D and flow pattern 45D are similar to the arc and flow path of the preferred embodiment of FIG. 3. Because solids accumulate in the restricted collinear section 66D, pressure losses are greater. This embodiment, then, is not preferred where the incoming stream is at low velocity and cannot supply sufficient force to expel the solids through outlet 65D. However, because of the restricted solids flow path, better deaeration is obtained and gas losses are minimal. The embodiment of FIG. 8 is a variation of the separator shown in FIG. 7 with the inlet and outlet oriented for use in a riser type reactor.

Figure 10:
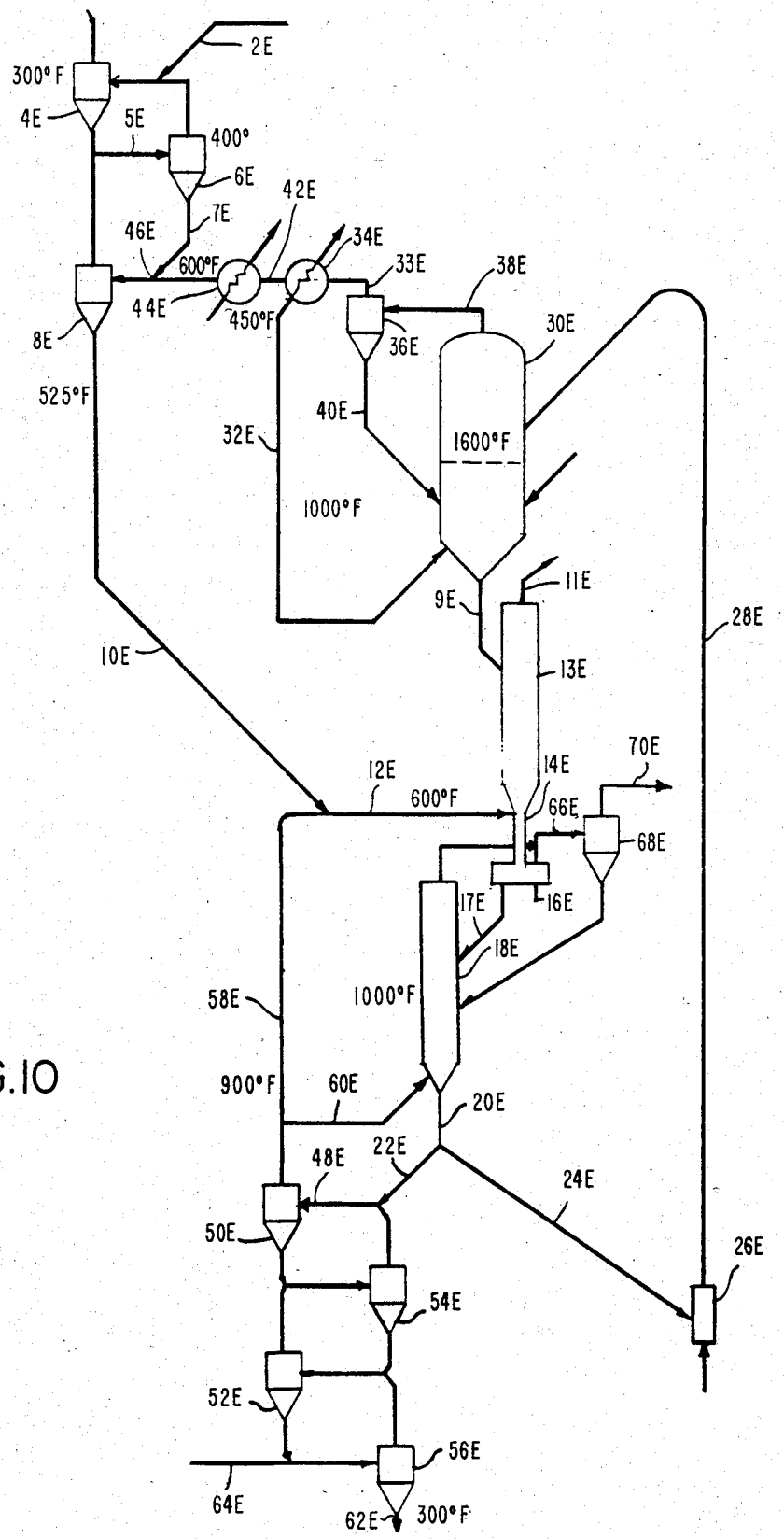
FIG. 10 is a schematic diagram of a hydrocarbon processing system which uses hot spent shale to provide reaction heat.

FIG. 10 is another schematic flow diagram that illustrates one of the alternative preferred ultra fast retort embodiments of the invention. The finely divided shale is passed through line 2E to preheater 4E, where it is heated to about 300° F. and passed via line 5E to a second preheater 6E where it is heated to 400° F. before being passed via line 7E to a third preheater 8E which raises the temperature to about 525° F. The pre-heated shale is then conducted by line 10E to the intake line 12E where the shale is combined with a hot gaseous stream and passed to the reactor 14E wherein about 50% of the hydrocarbon that is contained in the shale is recovered as a gas and oil vapor. The reactor 14E is fed with a portion of recycled spent shale from reservoir 13E which is vented by line 11E. Line 9E feeds combusted spent shale to reservoir 13E and is connected to separator 16E which divides the solid spent shale from the gaseous stream and passes it to stripper 18E via line 17E. Stripper 18E removes the residual gas and passes the spent shale to line 20E where the spent shale flow is divided into two streams, 22E and 24E. Stream 24E passes a portion of the spent shale to an air lifter 26E which transports spent shale via line 28E to shale combustor 30E to gasify residual unseparated hydrocarbons. The gasification in shale combustor 30E is carried out by hot air from line 32E which is heated by a portion of the hot gases produced in combustor 30E and directed to hot air heat exchanger 34E via line 33E. Separator 36E removes any fine solids from line 38E and returns them via line 40E to the shale combustor. Line 42E exits the hot air heat exchanger 34E carrying gas at about 450° F. to carry the gas to heat exchanger 44E wherein steam is used to raise the temperature of the gas stream to about 600° F. before it contacts fresh shale fines at intake port 46E.

Line 22E carries a portion of the spent shale to line 48E which is interconnected to a cyclone cascade composed of cyclones 50E, 52E, 54E and 56E which directly contact hot spent shale to produce a hot gaseous stream of methane or other recycled gas. The hot gaseous stream is passed from cyclone 50E via line 58E to line 12E where it raises the temperature of the fresh shale to about 600° F. before the fresh shale enters the reactor 14E. An offtake line 60E is passed to stripper 18E where it strips off the residual gaseous stream that is not separated in separator 16E. Spent shale is rejected from cyclone 56E through line 62E. Line 64E recycles gases from downstream recovery operations. The gaseous stream that is separated from the shale solids in separator 16E is passed via line 66E to a cyclone 68E. The gas and oil containing fraction is then passed by line 70E to an oil and gas recovery operation.

The embodiment of FIG. 10 may be operated by feeding in 7,000 tons per day (TPD) of oil shale. The products are:

| | |
|---|---|
| oil | 557 TPD |
| gas | 259 TPD |
| rejected spent shale | 5184 TPD |
| methane carrier feed | 528 TPD |
| solids/gas | 20:1 |
| reaction temperature | 1100° F. |
| reaction pressure | 10 psig |
| residence time | 1 second or less |

The embodiment of FIG. 10 may be operated by feeding 7000 tons per day (TPD) of tar sands. The products are:

| | |
|---|---|
| oil | 525 TPD |
| gas | 70 TPD |
| rejected sand | 6300 TPD |
| methane carrier | 528 TPD |
| solids/gas | 20:1 |
| reaction temperature | 1200° F. |
| reaction pressure | 10 psig |
| residence time | 1 second or less |

The embodiment of FIG. 10 may be operated using tar sands in a steam cracking mode at a feed rate of 7000 tons per day (TPD).

| | |
|---|---|
| Cracked gas | 280 TPD including 70 TPD ethylene |
| cracked oil | 315 TPD |
| rejected sand | 6300 TPD |
| steam carrier | 3500 TPD |
| solids/gas | 19:1 |
| reaction temperature | 1500° F. |
| reaction pressure | 10 psig |
| residence time | 1 second or less |

The embodiment of FIG. 10 may be operated by feeding anthracite or bituminous coal at a rate of 7000 tons per day (TPD). The products are:

| | |
|---|---|
| oil | 1260 TPD |
| gas | 1260 TPD |
| char | 3780 TPD (would make 300 million SCFD low btu gas) |
| ash | 700 TPD |
| inert-solid/coal | 2/1 |
| methane carrier | 350 TPD |
| reaction temperature | 1300° F. |
| solids in | 1800° F. |
| methane and coal in | 800° F. |
| residence time | 1 second or less |

The embodiment of FIG. 10 may be operated using a combination of shale and coal.

| | |
|---|---|
| Feed | 7000 TPD shale<br>5400 TPD coal |
| Products | |
| oil (combined) | 1529 TPD |
| gas (combined) | 1231 TPD |
| char | 2916 TPD |
| rejected spent shale | 5184 TPD |
| ash rejected | 540 TPD |
| solids/gas | 20/1 |
| residence time | 1 second or less |

We claim:

1. A process for separating hydrocarbons from a finely divided solid that contains hydrocarbons said process comprising:

(a) preheating a finely divided entrained hydrocarbon-containing solid;

(b) passing the preheated finely divided hydrocarbon-containing solids to a reaction zone where they are contacted with a gaseous stream at a sufficiently high temperature at a residence time of about 0.01 to 1.5 seconds to gasify from 30 to 60% by weight of the hydrocarbon and form a gaseous oil stream that comprises gas, oil and finely divided entrained hydrocarbon-containing solid;

(c) passing said gaseous oil stream to a separator where the spent finely divided hydrocarbon-containing solid is separated from the gaseous oil stream;

(d) passing the solid material obtained in the separator to a stripper wherein residual gaseous hydrocarbon vapors are removed and stripped hydrocarbon-containing solid is obtained; and (e) dividing the stream of stripped hydrocarbon-containing solid into two streams, a first stream being sent to a cyclone cascade for direct heat exchange with a recycle gas to furnish a hot gaseous stream to the reactor and to the stripper and a second portion passed to a gasifier and then recycled to the reactor.

2. A process as defined in claim 1 wherein the step of passing the preheated finely divided hydrocarbon-containing solid to a reactor comprises:

(a) delivering fluidized solids through a conduit to a mixing chamber; and (b) introducing gaseous feed into the stream of solids at an angle.

3. A process as defined in claim 1 or 2 wherein the finely divided hydrocarbon-containing solid is preheated by:

(a) heating the hydrocarbon-containing solid feed;

(b) initially flashing the heated hydrocarbon-containing solid feed; and (c) superheating the heated hydrocarbon-containing solid feed with a gaseous stream generated by combusting hydrocarbon containing solid.

4. A process as defined in claim 1 wherein spent hydrocarbon-containing solid is rejected from the cyclone cascade.

5. A process as defined in claim 4 wherein the reaction temperature is from 1100°–1500° F.

6. A process for separating hydrocarbon from a finely divided solid selected from the group consisting of oil shale, tar sands, coal and mixtures thereof, said process comprising:

(a) preheating finely divided hydrocarbon-containing solid;

(b) passing said preheated hydrocarbon-containing solid downwardly to a reaction zone;

(c) contacting said preheated hydrocarbon-containing solid in a mixing chamber with an angularly moving hot gaseous fluid to form a reaction mixture;

(d) holding said reaction mixture in a reaction zone for a residence time of from 0.01 to 1.5 seconds to gasify from 30 to 60% by weight of the entrained hydrocarbon in said shale oil, tar sands, coal or a mixture thereof and form a gas and oil stream that comprises oil and spent entrained hydrocarbon-containing solid;

(e) passing said mixture of a gaseous oil stream and spent entrained hydrocarbon-containing solid to a separator wherein the solids are separated;

(f) passing the gaseous stream to an oil recovery operation;

(g) passing the solids to a stripper wherein residual hydrocarbons are stripped; and (h) dividing the stripped solids into two streams, a first stream recycled to the reaction zone through a gasifier and a second stream passed to a cyclone cascade for direct heat exchange with a recycle gas to form a hot gaseous stream that is passed to the reaction zone.

7. A process as defined in claim 6 wherein the solid is oil shale.

8. A process as defined in claim 6 wherein the solid is tar sands.

9. A process as defined in claim 6 wherein the solid is coal.

10. A process as defined in claims 7, 8 or 9 wherein at least part of the preheating gaseous stream is generated by combusting a portion of the stripped solids.

* * * * *